US005245982A

United States Patent [19]

Trudeau

[11] Patent Number: 5,245,982

[45] Date of Patent: Sep. 21, 1993

[54] HYDRAULIC CONCRETE PILE CUTTER

[75] Inventor: Leon B. Trudeau, Winnipeg, Canada

[73] Assignee: L.B.T. Enterprises Ltd., Winnipeg, Canada

[21] Appl. No.: 905,401

[22] Filed: Jun. 29, 1992

Related U.S. Application Data

[63] Continuation-in-part of Ser. No. 553,387, Jul. 17, 1990, Pat. No. 5,139,006, which is a continuation-in-part of Ser. No. 331,958, Apr. 3, 1989, abandoned.

[51] Int. Cl.[5] ..... B28D 1/32

[52] U.S. Cl. ..... 125/12; 125/16.01; 83/694

[58] Field of Search ..... 125/12, 16.01, 23.01; 83/639, 694, 821, 824, 928; 30/289, 294; 144/34 R, 34 E

[56] References Cited

U.S. PATENT DOCUMENTS 4,124,015 11/1978 Isaksson ..... 125/23.01
4,197,828 4/1980 Schellhorn ..... 125/23.01
4,641,694 2/1987 Rohde ..... 144/34 E

FOREIGN PATENT DOCUMENTS 243981 11/1987 European Pat. Off. .
294267 12/1988 European Pat. Off. .

OTHER PUBLICATIONS

"Engineering Developments in the U.S.S.R." Civil Engineering and Public works Review, Dec. 1964, vol. 59, No. 12, London, p. 1511.

*Primary Examiner*—M. Rachuba
*Attorney, Agent, or Firm*—Murray E. Thrift; Stanley G. Ade; Adrian D. Battison

[57] ABSTRACT

A hydraulic concrete pile cutter includes a blade with a beveled cutting edge extending across most of one edge. The blade confronts an anvil plate for supporting the pile on the side opposite the blade. The single blade is driven through a concrete pile and against the anvil to shear the concrete matrix of the pile and to sever the reinforcement strands.

11 Claims, 6 Drawing Sheets

HYDRAULIC CONCRETE PILE CUTTER

CROSS REFERENCE TO RELATED APPLICATIONS

This application is a continuation-in-part of application Ser. No. 553,387, filed Jul. 17, 1990, now U.S. Pat. No. 5,139,006 which is a continuation in part application Ser. No. 331,958, filed Apr. 3, 1989 now abandoned.

FIELD OF THE INVENTION

This invention relates in one aspect to a cutting device for precast concrete piles; and in another aspect to a method of cutting precast concrete piles.

BACKGROUND

Most larger buildings today are constructed using precast concrete piles. Typically these concrete piles are polygonal in cross section and have lengths varying from 20 to 80 feet (6 to 24 meters). They have diameters ranging from 12 to 28 inches (305 to 710 mm. nominal), or more, between opposed flat faces. Reinforcing metal strands extend longitudinally of the pile.

In use, the piles are driven into the ground and are then cut off at about grade level, to provide support for a building. After being cut off, the top of the cut piles may be broken to remove the concrete matrix, while retaining the metal reinforcement intact, to allow for pouring of concrete around the reinforcement.

Common methods of cutting piles at grade level involve the use of explosives and jackhammers. Shock waves from blasting, and stresses, caused by jackhammers tend to damage the piles. The proportion of piles damaged by these techniques is typically between about 1 in 4 and 1 in 15. Blasting and the use of jackhammers are both dangerous and costly.

It is a principal object of the invention to provide a device specifically intended to cut precast concrete piles. A further principal object of the invention is to provide an improved method of cutting precast concrete piles. Other and further objects will become apparent to those skilled in the art from the specification, claims and drawing.

SUMMARY

According to one aspect of the present invention there is provided a method cutting off at a selected position therealong a reinforced concrete pile having a concrete matrix and elongate reinforcement strands and embedded therein, said method comprising;

providing a blade with a substantially straight cutting edge;

positioning the blade on one side of the pile at the selected position and oriented transversely of the pile;

providing an anvil with a substantially flat abutment face;

positioning the anvil at an opposite side of the pile from the blade, with the abutment face engaging the pile;

driving the blade into one side of the pile at the selected position while supporting the opposite side of the pile with the abutment face of the anvil, thereby to crack the concrete matrix of the pile;

tensioning the pile to propagate the crack across the concrete matrix; and driving the blade through the pile to bring the cutting edge of the blade into engagement with the abutment face of the anvil to sever the reinforcement strands.

In practise, the cutting edge first cracks the concrete matrix of the pile at the cut-off level selected. The blade edge is preferably wedge-shaped so that further driving of the blade into the pile will tension the pile and cause the crack to propagate across the concrete matrix. The reinforcing strands are sufficiently elastic that they will be stretched by the blade as it progresses along the crack in the concrete matrix. Most of the reinforcing strands will be sheared during this blade movement. It has been found, however that some of the reinforcing strands expecially those on the side of the pile furthest from the blade at the start of a cut, may not be sheared. This problem is solved by having the blade sever the reinforcement strands against the anvil.

A cleaner cut of the concrete matrix can be achieved if the anvil side of the pile is supported above and below the cutting plane. Thus, this aspect of the invention also provides a method cutting off at a selected position therealong a reinforced concrete pile with a predetermined cross section and having a concrete matrix and elongate reinforcement strands and embedded therein, said method comprising;

providing a blade with a substantially straight cutting edge;

positioning the blade on one side of the pile at the selected position and oriented transversely of the pile;

providing an anvil with a substantially flat abutment face and two concave support faces each matching a portion of the pile cross section;

positioning the anvil at an opposite side of the pile from the blade, with the abutment face and the support faces engaging the pile;

driving the blade into one side of the pile at the selected position while supporting the opposite side of the pile with the abutment face and the support faces of the anvil, thereby to crack the concrete matrix of the pile;

tensioning the pile to propagate the crack across the concrete matrix; and driving the blade through the pile to bring the cutting edge of the blade into engagement with the abutment face of the anvil to sever the reinforcement strands.

According to another aspect of the present invention there is provided an apparatus for cutting off a reinforced concrete pile at a selected position along the pile, said apparatus comprising;

a blade with a substantially straight cutting edge and a wedge-shaped profile along the cutting edge;

an anvil with a substantially flat abutment face;

frame means mounting the blade and anvil with the cutting edge of the blade confronting the anvil; and drive means for moving the blade from a retracted position spaced from the anvil to an advanced position in engagement with the anvil.

This aspect of the invention also provides an apparatus for cutting off a reinforced concrete pile with a predetermined cross section at a selected position along the pile, said apparatus comprising;

a blade with a substantially straight cutting edge and a wedge-shaped profile along the cutting edge;

an anvil with a substantially flat abutment face and two concave support faces each matching a portion of the pile cross section;

frame means mounting the blade and anvil with the cutting edge of the blade confronting the anvil; and drive means for moving the blade from a retracted position spaced from the anvil to an advanced position in engagement with the abutment face of the anvil.

BRIEF DESCRIPTION OF THE DRAWINGS

In the accompanying drawings, which illustrate exemplary of the present invention.

Figure 1:
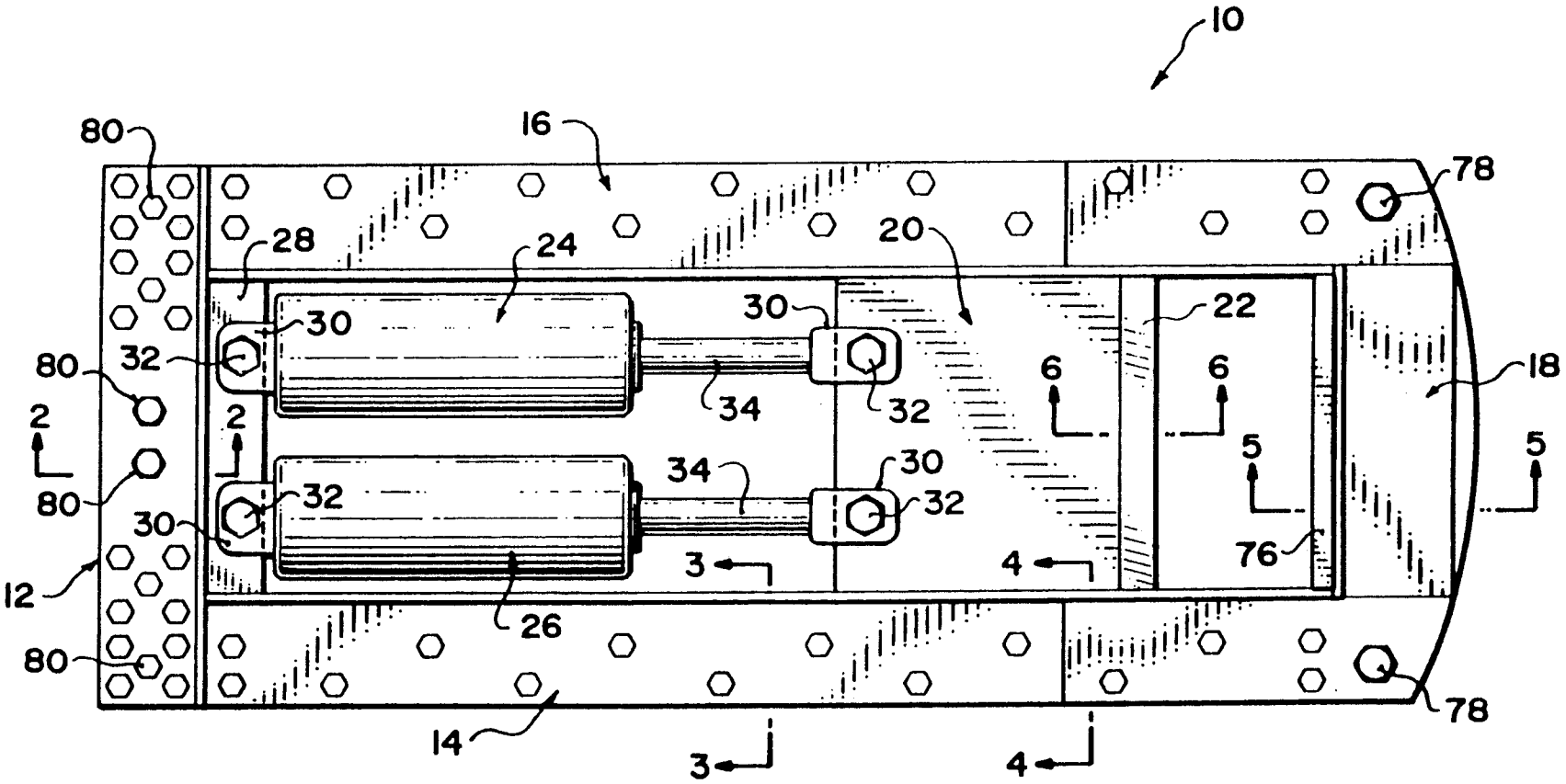
FIG. 1 is a plan view of a cutter according to the invention.

Referring to the drawings, the cutter generally indicated by numeral 10, is adapted to cut a reinforced concrete pile and includes rear cross member 12, side channel forming members 14 and 16, and anvil gate 18, and blade plate 20 including forward cutting edge 22. Hydraulic cylinders 24 and 26 are secured to plate 20 and a rear support plate 28 of the rear cross member by clevises 30 and bolts or pins 32. Extensible and retractable cylinder rods 34 move the cutter blade along the side members 14 and 16. The cylinders are 8 inch internal diameter capable of operating up to at least about 3,500 psi, preferably rated at up to 4,200 psi, with a stroke length of at least about 18 and more preferably 20 inches.

Figure 2:
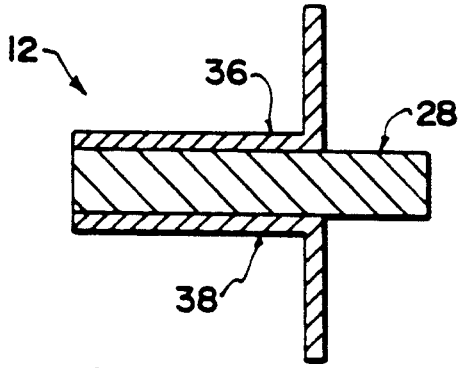
FIG. 2 is a cross sectional view of a rear cross member of the cutter of FIG. 1.
Figure 3:
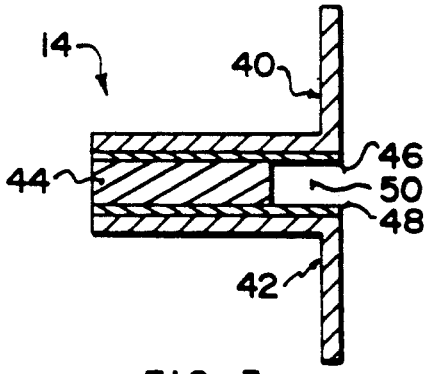
FIG. 3 is a cross sectional view of a side member of the cutter of FIG. 1.
Figure 4:
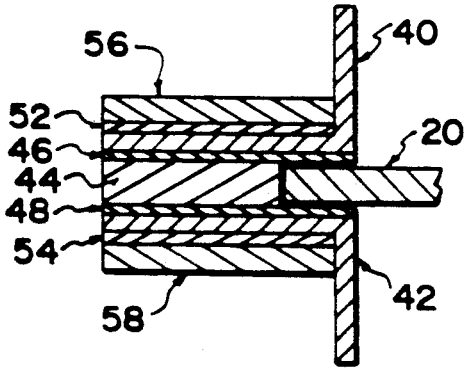
FIG. 4 is a cross sectional view of a reinforced portion of a side member of the cutter of FIG. 1.
Figure 5:
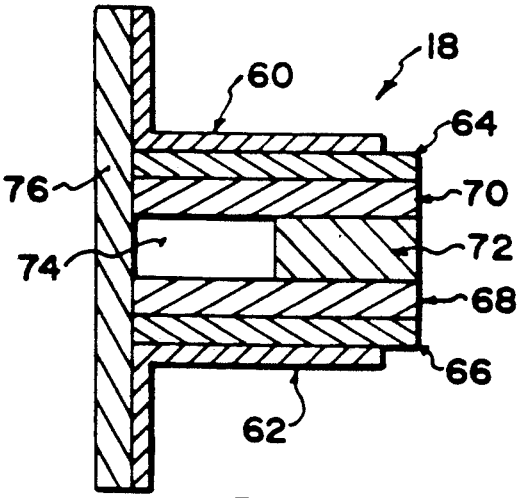
FIG. 5 is a cross sectional view of an anvil gate of the cutter of FIG. 1.
Figure 7:
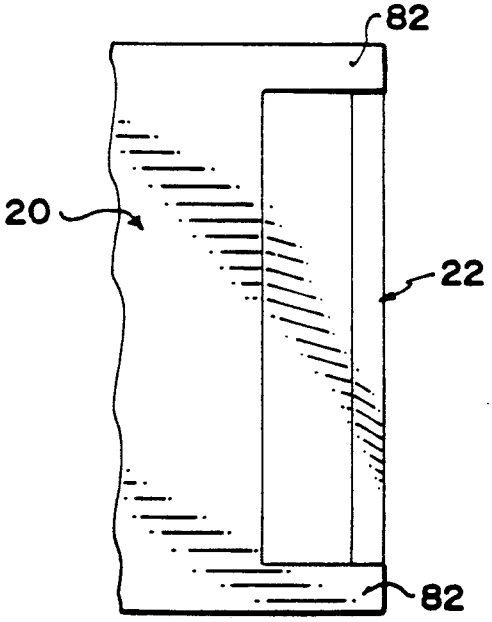
FIG. 7 is a partial plan view of the blade plate of FIG. 1.

Rear cross member 12 (FIG. 2) is formed by upper and lower angle irons 36 and 48 and rear support plate 28. Side member 14 has a rear portion (FIG. 3) comprising upper angle iron 40 and lower angle iron 42, side plate 44 and upper and lower wear plates 46 and 48. The side plate and wear plates from a channel 50. Angles 40 and 42 and plates 44, 46 and 48 all extend from rear member 12 forward. Side member 14 has a reinforced forward portion (FIG. 4) which, besides the elements shown in FIG. 3, shows channel 50 receiving blade plate 20. The reinforcement includes outer thin plates 52 and 54, and outer thicker plates 56 and 58. These plates extend some 22 inches along the forward end of side members 14. Anvil gate 18 (FIG. 5) has upper and lower angle irons 60 and 62, and a set of horizontal plates 64, 66, 68, 70, 72 middle plate 72 is set forward forming a recess 74. Plates 64 to 72 extend across the front of cutter 10 between side members 14 and 16. Anvil gate 18 has removable mild steel anvil plate 76, on its rear face, extending the depth of anvil gate 14 and between side members 14 and 16. Anvil gate 18 is removably secured to the side members 14 and 16 by bolts 78.

Figure 6:
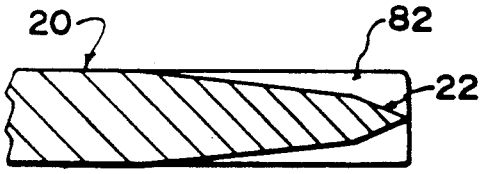
FIG. 6 is a partial cross sectional view of the blade plate of FIG. 1.

The cutter 20 (FIG. 6) has a doubled beveled cutting edge 22, extending between unbeveled side portions 82, which enable the cutter to slide in channels 50. An appropriate clearance is allowed above and on each side of the cutter in the channel.

Figure 8:
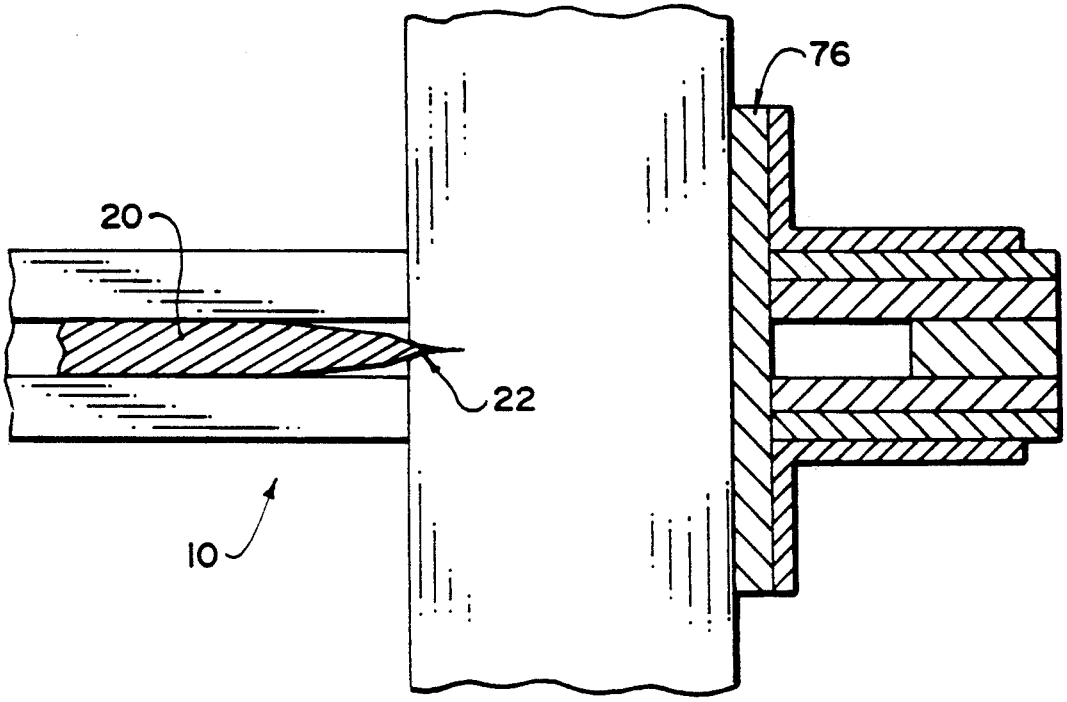
FIGS. 8 to 10 illustrate three stages in the pile cutting process.
Figure 9:
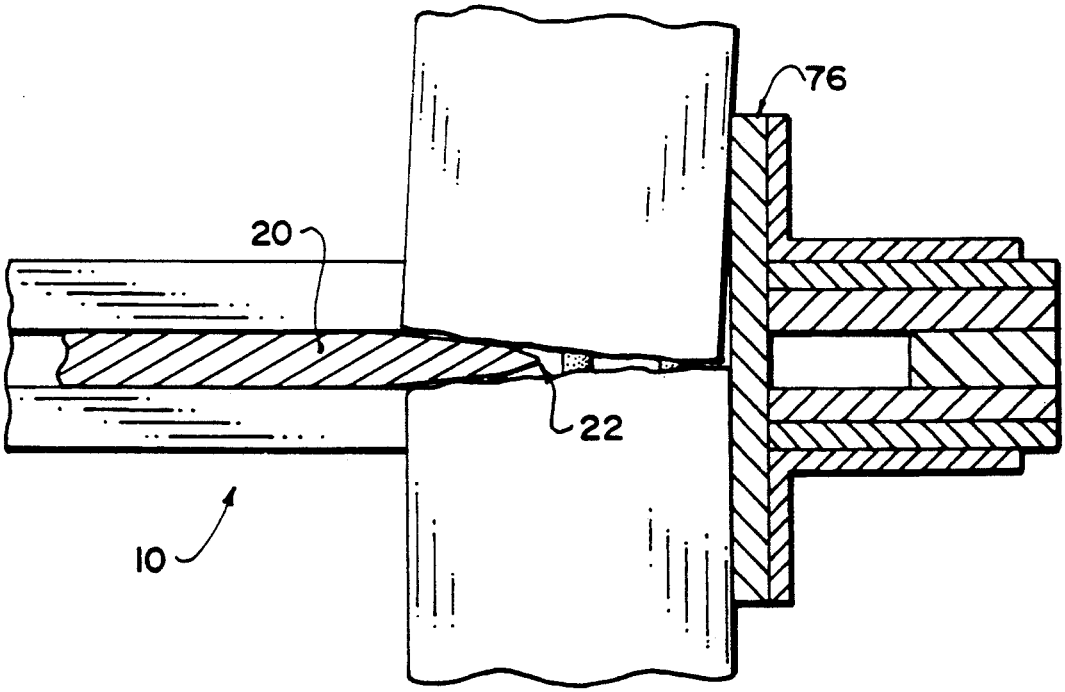
Figure 10:
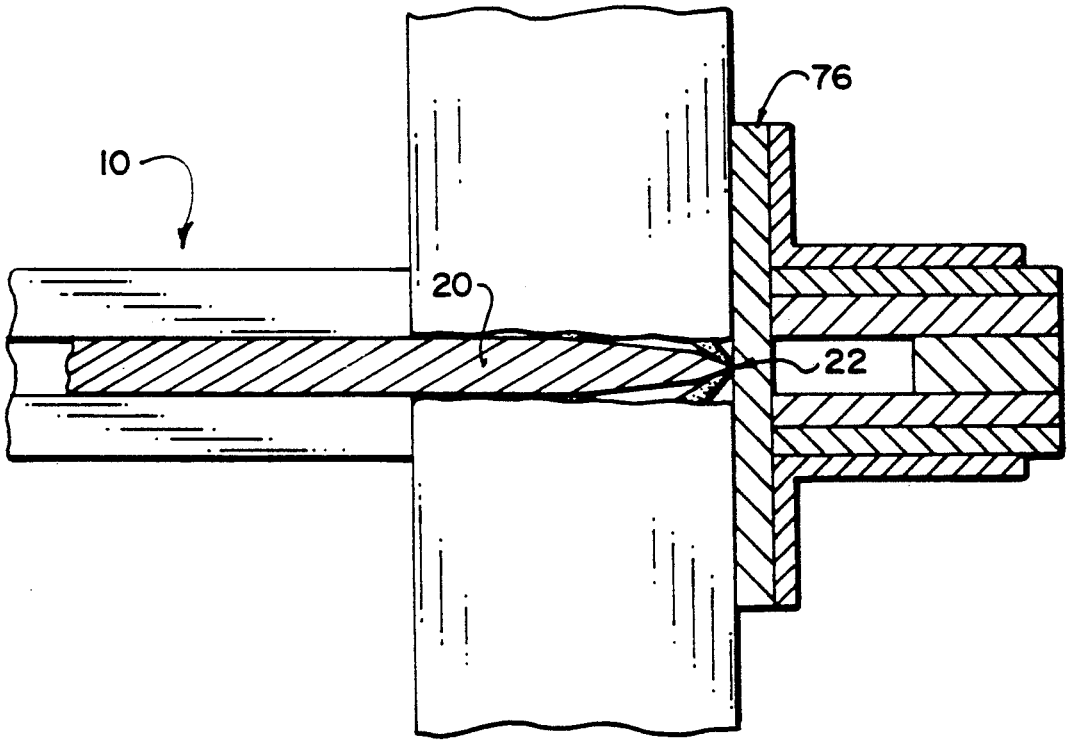

In use the cutter 10 is levelled about the pile to be cut, the blade 20 is then driven against the pile with anvil plate 76 supporting the opposite side of the pile. Cutting edge 22 stresses and cracks the pile as shown in FIG. 8. Continued driving of the blade into the pile tensions the pile at the crack because of the wedge shape of the blade at the cutting edge. This tensioning propagates the crack across the pile as shown in FIG. 9 to complete the separation of the concrete matrix. The blade will also cut most of the reinforcing strands as it progresses through the pile. Those strands that remain uncut at the completion of the blade's stroke are severed between the blade and the anvil as shown in FIG. 10.

FIGS. 11 through 14 illustrate an alternative anvil 209 to be mounted on the anvil gate 18. This anvil includes a back plate 210 with a front abutment face 212 for supporting the pile at the cut-off location and against which the blade engages when fully extended. The anvil also includes two supports 214 and 216 respectively above and below the abutment face. Each support consists of two wedge-shaped elements 218 projecting from the front face of the plate 210. As illustrated most particularly in FIG. 13, each element includes a support plate 220 that slopes outwardly from the front face of the back plate 210, an outer side plate 222 and an end plate 224 joining the forward edges of the support and side plates. Internally, the support plate is reinforced with a reinforcement plate 226 extending from the junction of the back plate 210 and the side plate 222 to the middle of the support plate. The top and bottom of the upper elements 218 are closed with top plates 228 and bottom plates 230 respectively.

Figure 11:
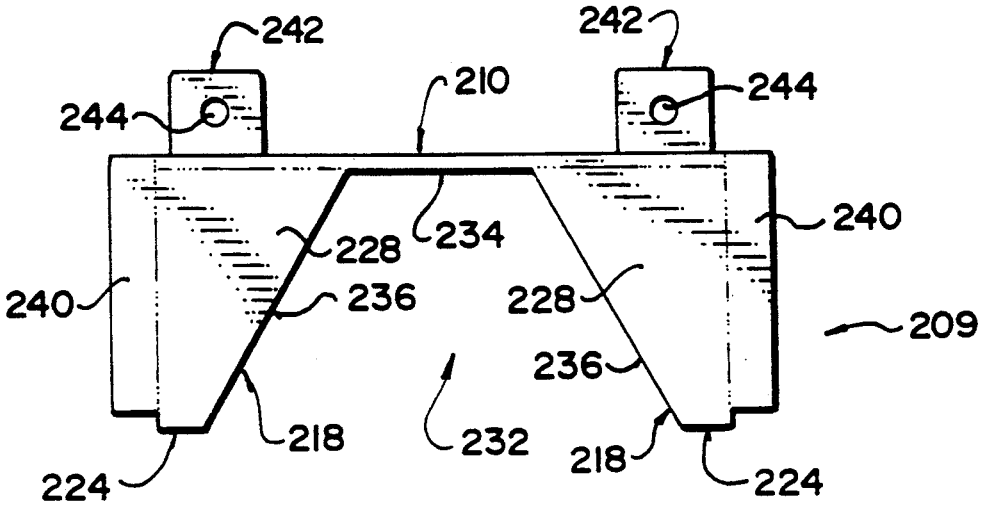
FIG. 11 is a plan view of an anvil with a pile support.
Figure 13:
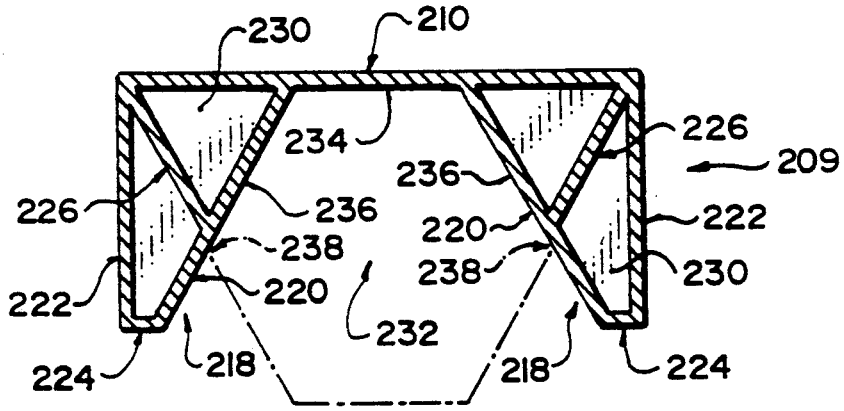
FIG. 13 is a cross section along line 13—13 of FIG. 12.

As shown most particularly in FIGS. 11 and 13, each support provides a concave support face 232 that matches a portion of the cross section of a pile to be cut. In the present embodiment, the pile is hexagonal and the support face 232 has a centre segment 234 and diverging outer segments 236 that engage and support three adjacent faces of the hexagonal pile. The outer segments 236 are longer than the centre segment and project beyond the corners 238 of the pile (FIG. 13) to be cut so that of the six corners on the hexagonal pile, four are supported by the anvil and the other two are at edges of the pile that is first engaged with the cutting blade. It has been found that the use of the concave supports matching the pile cross section significantly improves the quality of the cut by limiting the propagation of any cracking beyond the cut-off plane.

The anvil 209 has two outwardly projecting side flanges 240 and two lugs 242 on the back side. The flanges 240 rest on the sides 14 and 16 of the cutter frame, on the top of angles 40. The lugs 242 are provided with holes 244 to accomodate pins holding the anvil in place on the anvil gate.

Figure 14:
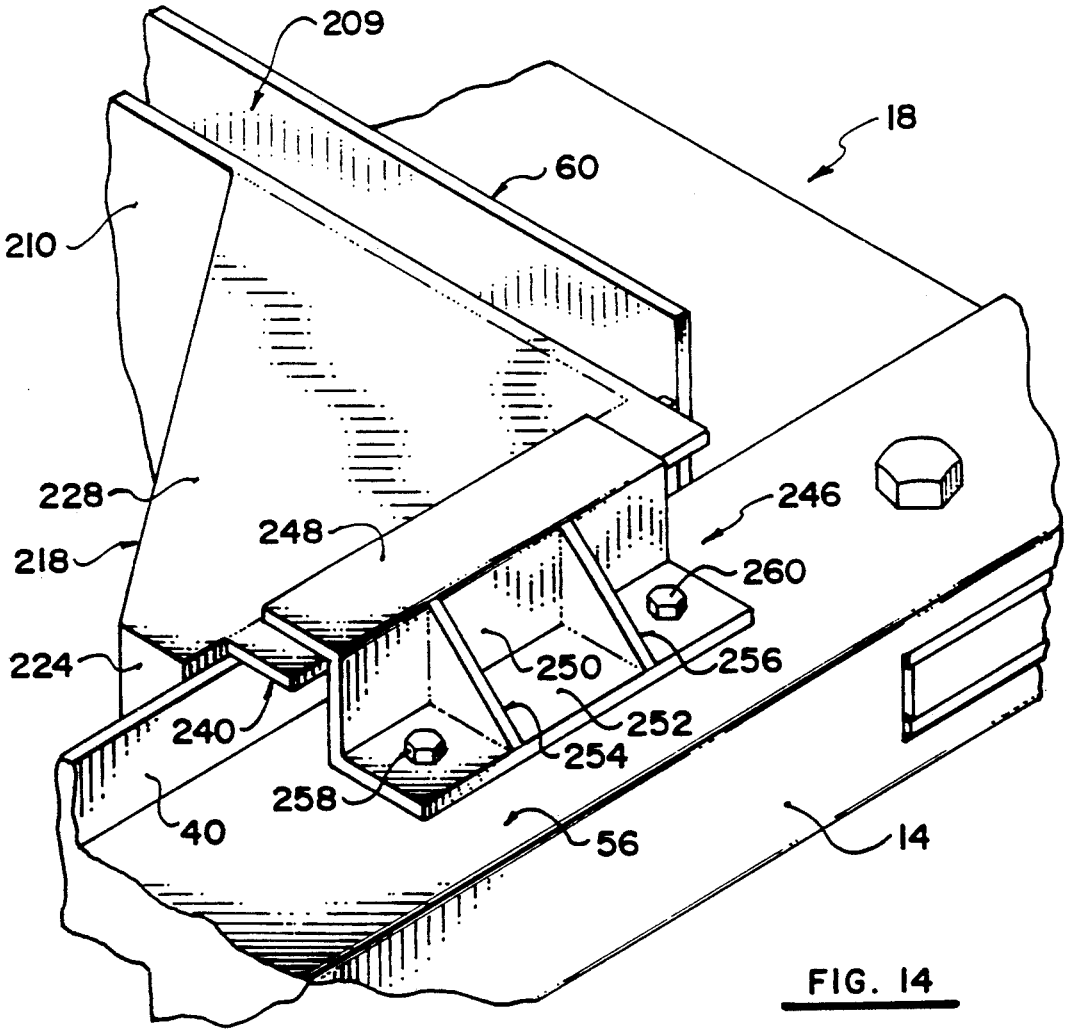
FIG. 14 is an isometric showing the mounting of the anvil of FIGS. 11, 12 and 13.

The flanges 240 are secured to the sides of the cutter frame by two brackets 246, one of which is shown in FIG. 14. Each bracket includes a top flange 248 that extends over the associated flange 240 a vertical web 250 extends from the outer side of the flange to a base flange 252 on which is it supported by gussets 254 and 256. Two bolts 258 and 260 mount the base flange 252 on the side 14 of the cutter frame.

Figure 12:
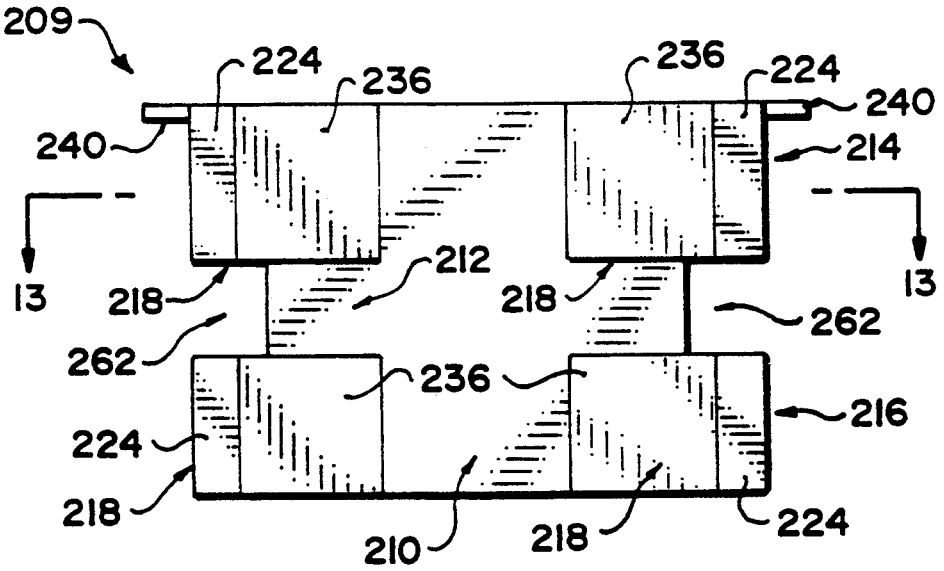
FIG. 12 is a front view of the anvil of FIG. 11.

As illustrated most particularly in FIG. 12, the abutment face 212 of the back plate 210 is narrower than the supports 214 and 216. This leaves recesses 262 at opposite sides that allow the ejection of any broken concrete that might have accumulated in the cutting process. For the same purpose, the top and bottom of the bottom elements 218 are open.

While one embodiment of the invention has been described in the foregoing, it is to be understood that other embodiments are possible within the scope of the invention. The invention is to be considered limited solely by the scope of the appended claims.

I claim:

1. A method of cutting off at a selected position therealong a reinforced concrete pile having a concrete matrix and elongate reinforcement strands embedded therein, said method comprising;

providing a blade with a substantially straight cutting edge;

positioning the blade on one side of the pile at the selected position and oriented transversely of the pile;

providing an anvil with a substantially flat abutment face;

positioning the anvil at an opposite side of the pile from the blade, with the abutment face engaging the pile;

driving the blade into one side of the pile at the selected position while supporting the opposite side of the pile with the abutment face of the anvil, thereby to crack the concrete matrix of the pile;

tensioning the pile to propagate the crack across the concrete matrix; and driving the blade through the pile to bring the cutting edge of the blade into engagement with the abutment face of the anvil throughout the length of the cutting edge to sever the reinforcement strands.

2. A method according to claim 1 wherein the step of providing a blade comprises providing a blade with a wedge-shaped cutting edge and wherein driving the blade into the concrete matrix of the pile wedges the matrix apart at the selected position.

3. An apparatus for cutting off a reinforced concrete pile at a selected position along the pile, said apparatus comprising;

a blade with a substantially straight cutting edge and a wedge-shaped profile along the cutting edge;

an anvil with a substantially flat abutment face;

frame means mounting the blade and anvil with the cutting edge of the blade confronting the anvil; and drive means for moving the blade from a retracted position spaced from the anvil to an advanced position with the cutting edge in edge-to-face engagement with the abutment face of the anvil, throughout the length of the cutting edge.

4. In a cutting apparatus for shearing a reinforced concrete pile and reinforcements therein at a predetermined height including frame means having a rear cross member, parallel spaced apart channel members having first and second ends, and demountable transverse anvil means with a flat abutment face, said first ends of said channel members being operatively associated with said rear cross member, said second ends of channel members being operatively associated with said demountable transverse anvil means; cutter blade means comprising an integral plate having a double beveled substantially linear cutting edge the plate extending between said channel members and being slidable therein between a first retracted position and a second extended position, the cutting edge of the blade means engaging said abutment face of the transverse anvil means throughout the length of the cutting edge in said second extended position, hydraulic ram means operatively associated with said rear cross member and said cutter blade means, whereby a concrete pile between said anvil means and said cutter blade means can be cut by moving said cutter blade means from said first position to said second position.

5. The cutting apparatus of claim 4, wherein said hydraulic ram means includes paired hydraulic cylinder means and said transverse anvil means is demountably attached to said channel members by removable bolts extending through aligned holes in said channel members and said transverse anvil means.

6. A method of cutting off at a selected position therealong a reinforced concrete pile with a predetermined cross section and having a concrete matrix and elongate reinforcement strands embedded therein, said method comprising;

providing a blade with a substantially straight cutting edge;

positioning the blade on one side of the pile at the selected position and oriented transversely of the pile;

providing an anvil with a substantially flat abutment face and two concave support faces each matching a portion of the pile cross section;

positioning the anvil at an opposite side of the pile from the blade, with the abutment face and the support faces engaging the pile;

driving the blade into one side of the pile at the selected position while supporting the opposite side of the pile with the abutment face and the support faces of the anvil, thereby to crack the concrete matrix of the pile;

tensioning the pile to propagate the crack across the concrete matrix; and driving the blade through the pile to bring the cutting edge of the blade into engagement with the abutment face of the anvil throughout the length of the cutting edge to sever the reinforcement strands.

7. A method according to claim 6 wherein the step of providing a blade comprises providing a blade with a wedge-shaped cutting edge and wherein driving the blade into the concrete matrix of the pile wedges the matrix apart at the selected position.

8. A method according to claim 6 wherein the pile has a polygomal cross section with adjacent faces meeting at a predetermined angle and each support face comprises plural flat segments with adjacent segments meeting at said predetermined angle.

9. An apparatus for cutting off a reinforced concrete pile with a predetermined cross section at a selected position along the pile, said apparatus comprising;

a blade with a substantially straight cutting edge and a wedge-shaped profile along the cutting edge;

an anvil with a substantially flat abutment face and two concave support faces each matching a portion of the pile cross section;

frame means mounting the blade and anvil with the cutting edge of the blade confronting the abutment face of the anvil; and drive means for moving the blade from a retracted position spaced from the anvil to an advanced position with the cutting edge in engagement with the abutment face of the anvil throughout the length of the cutting edge.

10. Apparatus according to claim 9 wherein the pile has a polygonal cross section with adjacent faces meeting at a predetermined angle and each support face comprises a plurality of flat segments with adjacent segments meeting at said predetermined angle.

11. Apparatus according to claim 10 wherein one of the flat segments of each support face is co-planar with the abutment face.

* * * * *